US006506219B2

(12) United States Patent
Kondo

(10) Patent No.: US 6,506,219 B2
(45) **Date of Patent: *Jan. 14, 2003**

(54) METHOD OF MANUFACTURING AN ARTICLE OF CLOTHING

(75) Inventor: Norichika Kondo, Nagoya (JP)

(73) Assignee: Konsei Co., Ltd., Nagoya (JP)

( * ) Notice: Subject to any disclaimer, the term of this patent is extended or adjusted under 35 U.S.C. 154(b) by 80 days.

This patent is subject to a terminal disclaimer.

(21) Appl. No.: 09/725,963

(22) Filed: Nov. 30, 2000

(65) Prior Publication Data

US 2001/0004788 A1 Jun. 28, 2001

Related U.S. Application Data

(63) Continuation-in-part of application No. 09/401,786, filed on Sep. 22, 1999, now Pat. No. 6,174,336.

(51) Int. Cl.[7] ..... D06M 10/00; D06C 23/04

(52) U.S. Cl. ..... 8/114; 8/115

(58) Field of Search ..... 26/18.5; 28/167; 223/51, 57; 8/114, 115

(56) References Cited

U.S. PATENT DOCUMENTS

| | | | | |
|---|---|---|---|---|
| 4,951,483 A | | 8/1990 | van Olphen | 68/213 |
| 5,356,055 A | * | 10/1994 | Takizawa | |

FOREIGN PATENT DOCUMENTS

| | | | |
|---|---|---|---|
| EP | 1088926 A2 | * | 4/2001 |
| JP | 54-68484 | | 6/1979 |
| JP | 54-68500 | | 6/1979 |
| JP | 63-256779 | | 10/1988 |
| JP | 1-162882 | | 6/1989 |

* cited by examiner

*Primary Examiner*—Margaret Einsmann
(74) *Attorney, Agent, or Firm*—Armstrong, Westerman & Hattori, LLP

(57) ABSTRACT

A method of manufacturing an article of clothing includes the steps of providing an article of clothing having a single large size, subjecting the article to a tying process, and subjecting the article of clothing to a shrinking process after the tying process to obtain a tie-shrunk article of clothing having an entirely reduced size with elasticity due to the shrinkage of tie-shrunk article of clothing, so that an entire portion of the single large size article of clothing fits a wearer of any size.

2 Claims, 6 Drawing Sheets

METHOD OF MANUFACTURING AN ARTICLE OF CLOTHING

This is a Continuation-in-Part of U.S. patent application Ser. No. 09/401,786, filed Sep. 22, 1999 U.S. Pat. No. 6,174,336.

BACKGROUND OF THE INVENTION

1. Field of the Invention

The present invention relates to a method of manufacturing an article of clothing, and more particularly to, a method of manufacturing a tie-shrunk article of clothing which can fit a wearer of any size.

2. Description of Related Art

In the prior art, tie dyed products are formed freely in that the dye stuff does not enter tied or covered portions that are formed by various tying processes such that the undyed portions are expressed as patterns. Otherwise, the dyed portions, such as the tied portions by various tying processes or the covered portions, are previously dyed or dyed afterward. It is well known that patterns resulting from various dyeing methods are quite numerous.

In the present situation, these tie dyeing processes are adopted so that patterns or designs are expressed, and while succession of traditional technical art of hand tie dyeing is intended, ornamental properties, aesthetic sense and elegance for the tie dyed article of clothing are improved. In cotton products (cotton stuff) such as a bathrobe or a blouse, advantages of providing a sense of high quality and enabling utilization such as, for example, an outdoor dress or a visiting dress by providing the sense of high quality, are useful for the practical benefit.

As described above, in the present situation, the tie dyeing process is adopted so as to improve the ornamental properties, the aesthetic sense and the elegance of the tie dyed article, and in cotton products such as a bathrobe or a blouse, the tie dyeing process provides advantages of a sense of high quality and enabling utilization such as an outdoor dress or a visiting dress. However, the utilization in such manner means that the tie dyeing article is limited to only one aspect.

For example, when the elasticity based on the tie dyeing process and the physical property of the cloth are utilized effectively, it is clear that the tie dyeing article has better characteristics and its value as an article for commerce is improved and the field of utilization can be developed. For example, when an article of clothing such as a blouse with elasticity is manufactured utilizing the elasticity and the physical property, the article of clothing is fitted to a human body to express the figure of the human body gently without producing creases (i.e., to fully express the figure of a beautiful woman), or utilizing the small dimension of the blouse so that the clothing can be accommodated compactly, and this is useful for journeys, accommodations, or the like. The tie dyeing process can also be utilized for the function as essentially required by the clothing piece. For example, the tie dyeing process is useful for functions such as tightening of sleeve ends or tightening of a belly.

SUMMARY OF THE INVENTION

The purpose of the present invention is to provide a method of manufacturing an article of clothing which can fit a wearer of any size.

According to the present invention, a method of manufacturing an article of clothing, comprising the steps of:

providing an article of clothing having a single large size;

subjecting the article of clothing to a tying process; and subjecting the tied article of clothing to a shrinking process after the tying process to obtain a tie-shrunk article of clothing having an entirely reduced size with elasticity due to the shrinkage of the tie-shrunk article of clothing, so that an entire portion of the single large size article of clothing fits a wearer of any size.

It is preferable that the aforementioned tying process is one of a looped binding process, a spiderweb binding process, a linked dots binding process, a square ring dots binding process and a rolling up process.

Furthermore, it is preferable that the aforementioned shrinking process is a heat shrink treatment.

Other objects and advantages of the present invention will become apparent from the description of the preferred embodiments, which may be modified in any manner without departing from the scope and spirit of the present invention.

DETAILED DESCRIPTION OF THE PREFERRED EMBODIMENTS

An embodiment of the present invention will be described based on the accompanying drawings.

Figure 1:
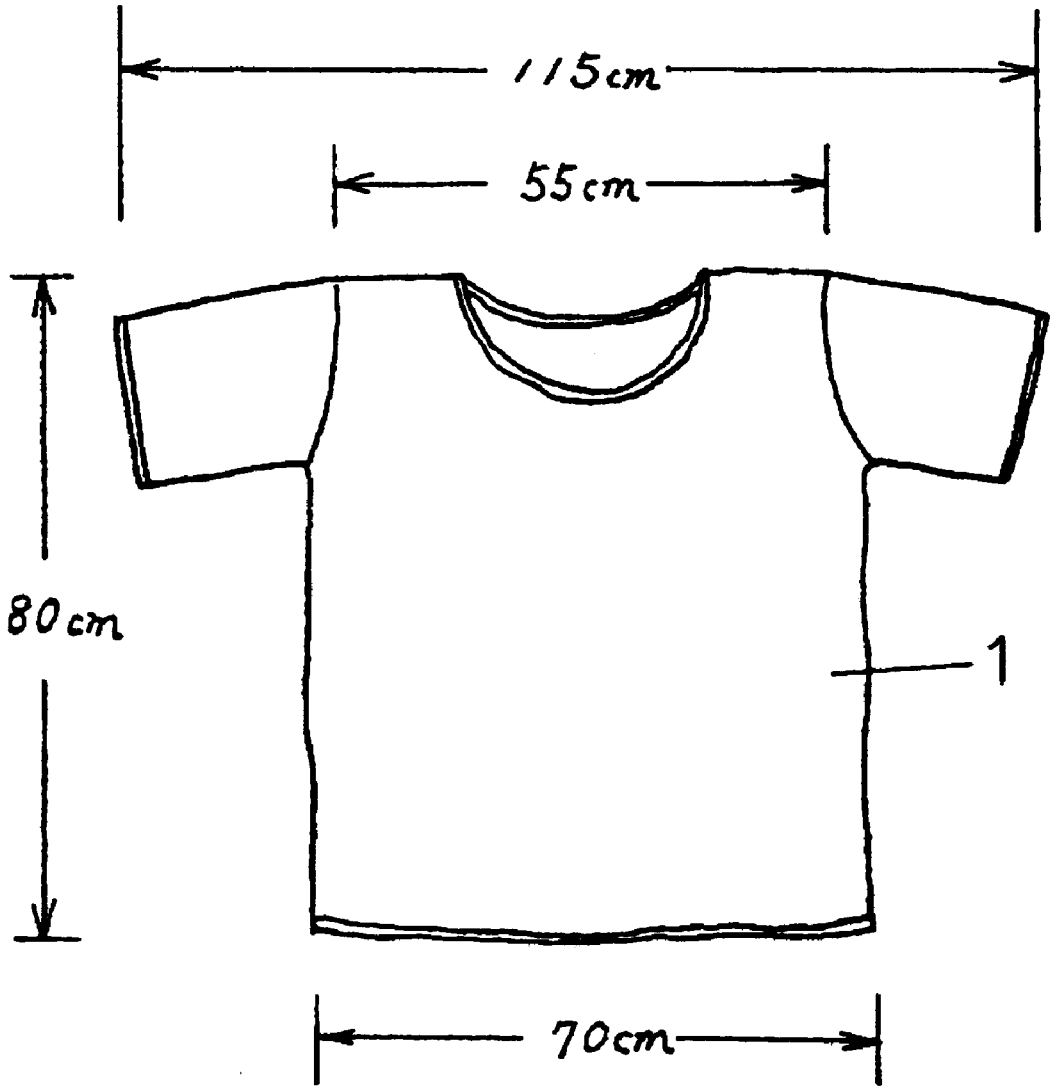
FIG. 1 is a front view showing an original article of clothing having a single large size before subjecting to a tying process.
Figure 2A:
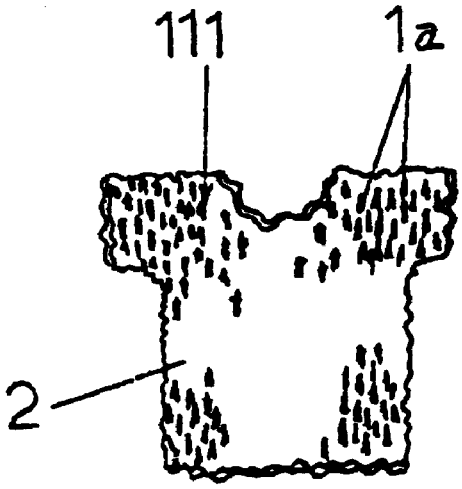
FIG. 2A shows a looped binding process (MIURA SHIBORI process) subjected to the original article of clothing shown in FIG. 1.
Figure 2B:
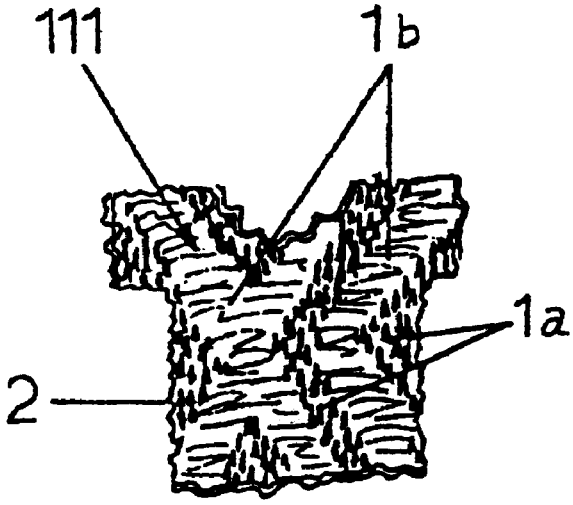
FIG. 2B shows a looped binding process (MIURA SHIBORI process) and a tying process subjected to the original article of clothing shown in FIG. 1.
Figure 3:
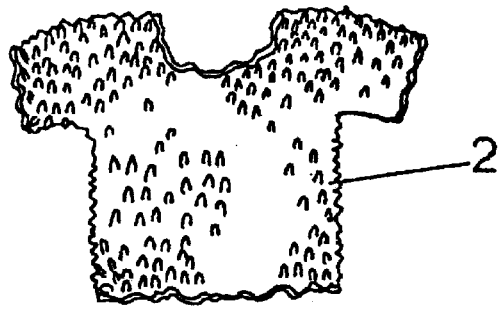
FIG. 3 is a front showing a tied article of clothing utilizing the tying process shown in FIG. 2A.

A prescribed portion 111 of an article of clothing 1 shown in FIG. 1 is subjected to a tying process such as rolling up 1*a* or tying 1*b* as shown in FIGS. 2A and 2B to obtain a tied article of clothing as shown in FIG. 3.

In FIG. 2A, substantially the whole surface of the article of clothing 1 is subjected to a tying (binding) process (ex. a looped binding process (MIURA SHIBORI process), a spiderweb binding process (KUMO SHIBORI process), a linked dots binding process (TATEBIKI KANOKO SHIBORI process) or a square ring dots binding process (YOKOBIKI KANOKO SHIBORI process)). In FIG. 2B, substantially the whole surface of the article of clothing 1 is subjected to a MIUMA SHIBORI process and a tying process.

If necessary, the aforementioned tied article of clothing 2 is dyed by a conventional dyeing method such as an immersion method. The aforementioned tied article of clothing as shown in FIG. 3 is then subjected to a heat shrink treatment to form a tie-shrunk article of clothing 3 as shown in FIG. 4.

For example, in cases where the original article of clothing 1 is made of polyester, the heat shrink treatment is performed at about 130° C. to 140° C. for about 30 to 40 minutes in order to shrink the tied article of clothing 2.

After the heat shrink treatment, a finishing process is performed. The order of the aforementioned process/treatment, the time of the process/treatment and the like can be arbitrary changed depending on various factors including the type of product, the cost, simplification of process, facilities and the manner of various processes.

Figure 4:
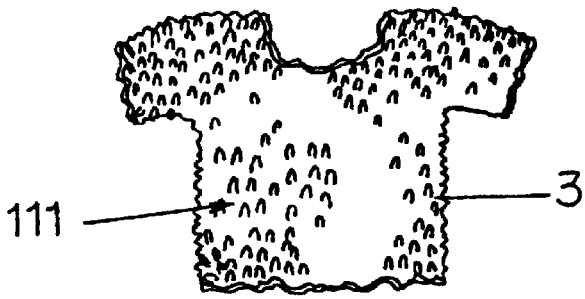
FIG. 4 is a front view showing a tie-shrunk article of clothing utilizing the tying process shown in FIG. 2A.

In FIG. 4, the shrinking process is applied to the whole surface of the tied article of clothing 3.

Figure 5:
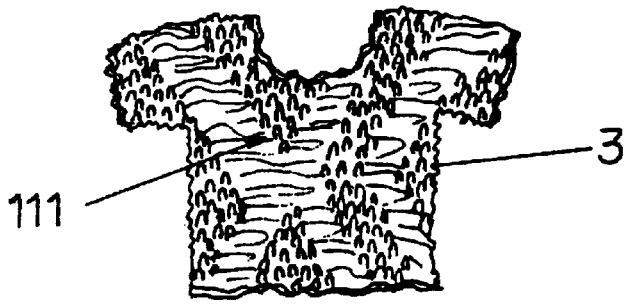
FIG. 5 is a front view showing a tie-shrunk article of clothing utilizing another tying process.

FIG. 5 shows another embodiment of a tie-shrunk article of clothing 3.

As will be apparent from the above, the whole article of clothing 1 is subjected to a tying process and then subjected to a shrinking process to form a tie-shrunk article of clothing 3. The size of the tie-shrunk article of clothing 3 is reduced greatly due to the elasticity caused by the tying and shrinking processes. Consequently the tie-shrunk article of clothing 3 can fit to a wearer of any size without causing any creases.

FIG. 1 shows an example of dimensions of the original article of clothing 1, where the shoulder width is 55 cm, the width in breast and body is 70 cm, the whole height is 80 cm and the whole shoulder width with sleeves is 115 cm.

Figure 8:
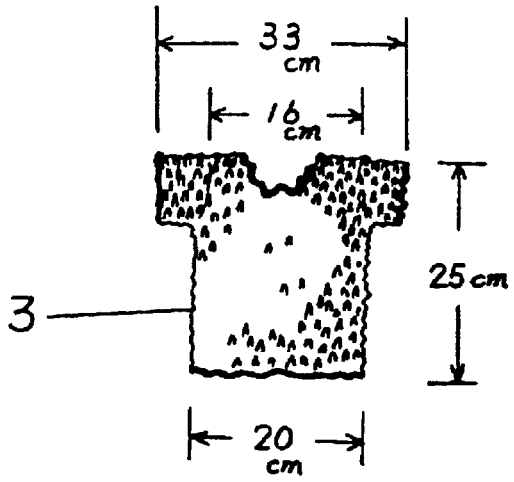
FIG. 8 is a front view showing dimension indication that the tie-shrunk article of clothing as shown in FIG. 4 is in a shrunk state.

FIG. 8 shows an example of dimensions of the tie-shrunk article of clothing 3 in a shrunk state, where the shoulder width is 16 cm, the width in breast and body is 20 cm, the whole height is 25 cm and the whole shoulder width with sleeves is 33 cm.

Figure 9:
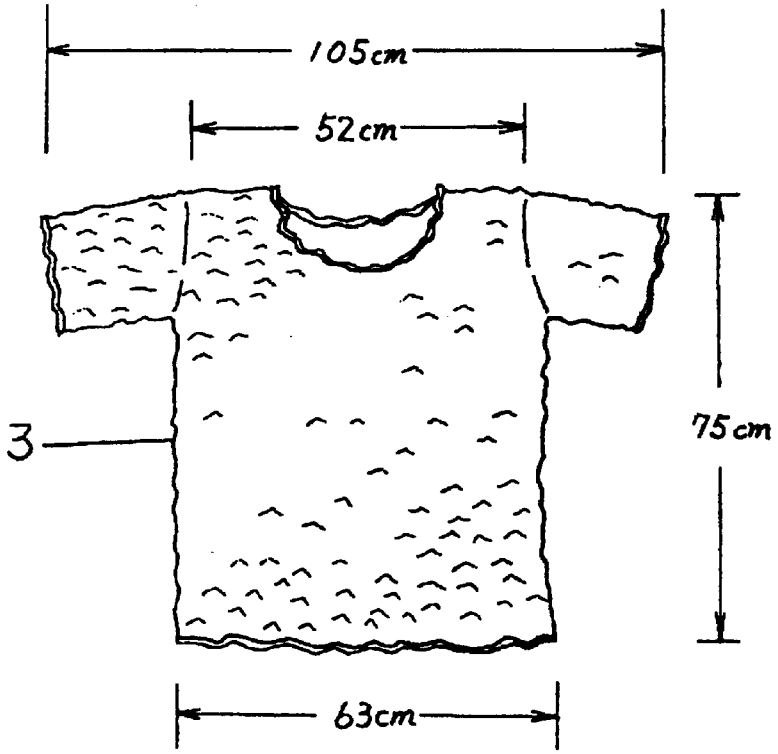
FIG. 9 is a front view showing dimension indication that the tie-shrunk article of clothing as shown in FIG. 4 is in an enlarged state.

The aforementioned tie-shrunk article of clothing 3 can be expanded to the dimensions as shown in FIG. 9. In the enlarged state, the shoulder width is 52 cm, the width in breast and body is 63 cm, the height is 75 cm and the whole shoulder width with sleeves is 105 cm.

Figure 6:
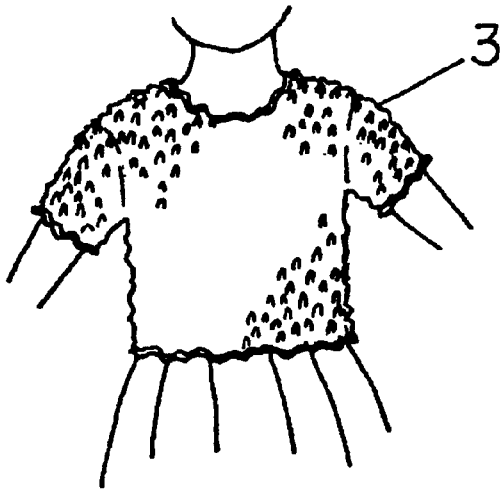
FIG. 6 is a front view showing an example where the tie-shrunk article of clothing shown in FIG. 4 is worn by a child.
Figure 7:
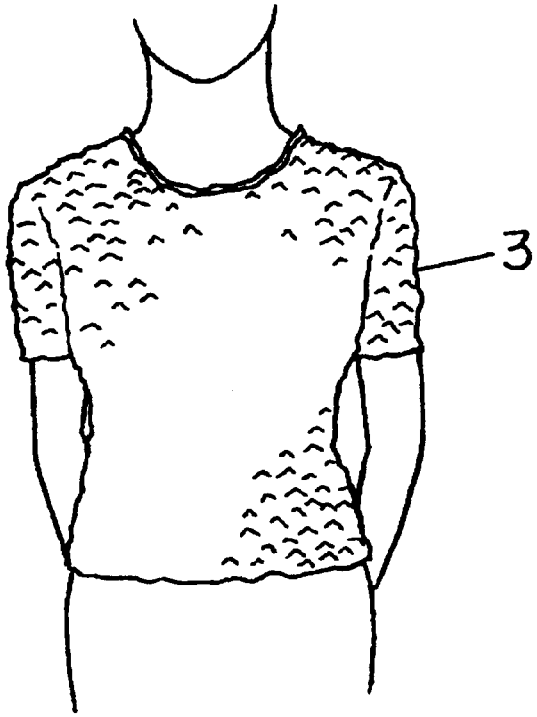
FIG. 7 is a front view showing an example where the tie-shrunk article of clothing shown in FIG. 4 is worn by an adult.

FIG. 6 shows an example that the tie-shrunk article of clothing 3 shown in FIG. 4 is worn by a child, and FIG. 7 shows an example that the same tie-shrunk clothing 3 shown in FIG. 4 is worn by an adult.

Figure 10:
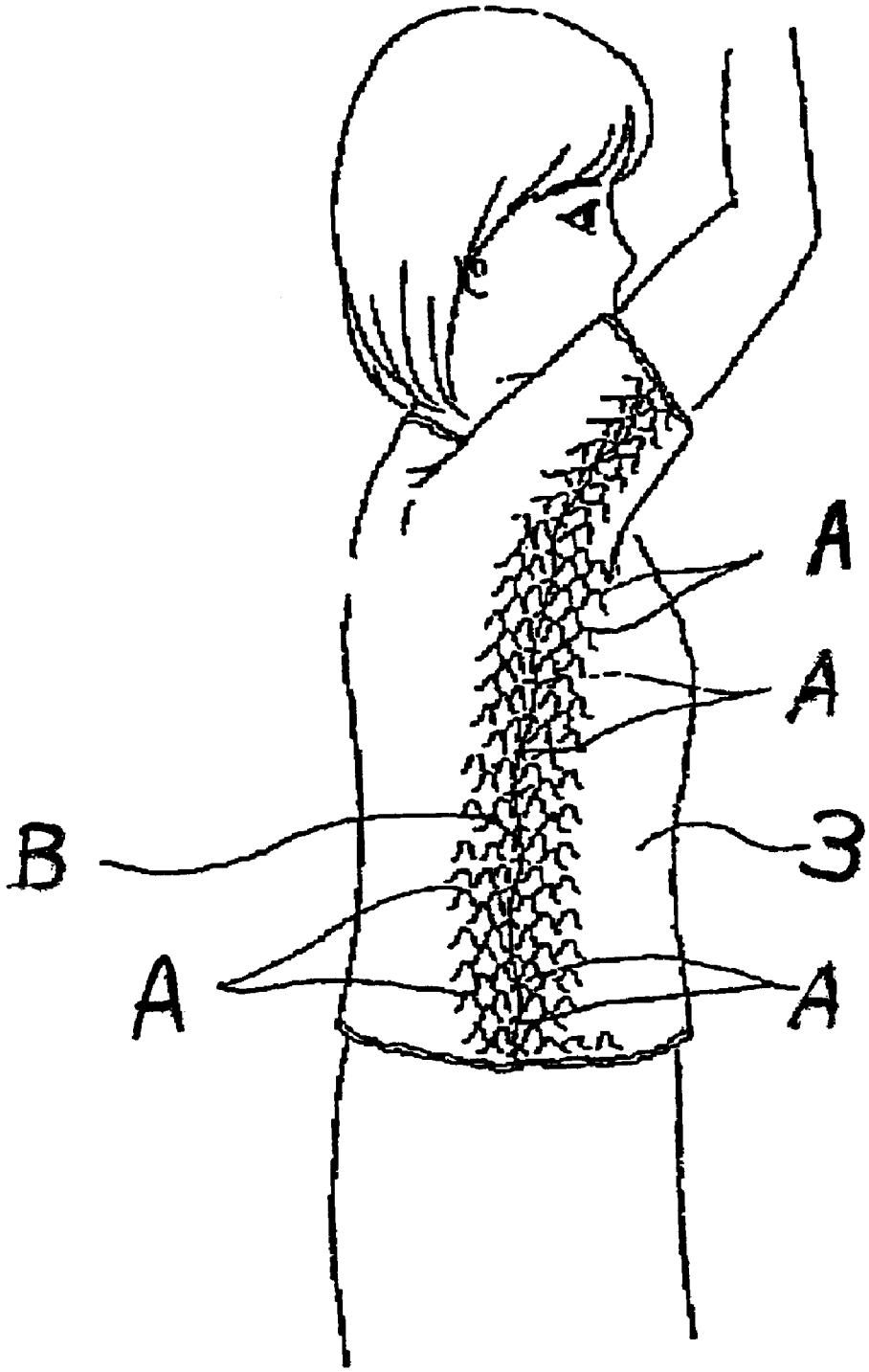
FIG. 10 is a side view showing an example where the tie-shrunk article of clothing shown in FIG. 4 is worn by an adult.

FIG. 10 is a side view showing an example where the tie-shrunk article of clothing 3 shown in FIG. 4 is worn by an adult. As shown in FIG. 10, the tied pattern or design A can be clearly obtained keeping its original shape, i.e., without being deformed, even at the seamed portion B by subjecting an article of clothing to a tying process after preparing the article of clothing.

As will be understood from the aforementioned embodiments, according to the present invention, the tie-shrunk article of clothing which can fit a wearer of any size including from a child to an adult can be manufactured.

The terms and expressions which have been employed herein are used as terms of description and not of limitation, and there is no intent, in the use of such terms and expressions, of excluding any equivalents of the features shown and described or portions thereof, but it should be recognized that various modifications are possible within the scope of the invention claimed.

What is claimed is:

1. A method of manufacturing an article of clothing, comprising the steps of:

providing an article of clothing having a single large size;

subjecting said article of clothing to a tying process comprising tying up the cloth of the clothing, wherein said tying process is one of a looped binding process, a spiderweb binding process, a linked dots binding process, and a square ring dots binding process; and subjecting said article of clothing to a shrinking process, after said tying process to obtain a tie-shrunk article of clothing having an entirely reduced size with elasticity so that the tie-shrunk article of clothing after the shrinking process fits a wearer of any size.

2. The method of claim 1, wherein the shrinking process is a heat shrink treatment.

* * * * *